US007965852B2

(12) United States Patent
Kobayashi

(10) Patent No.: US 7,965,852 B2
(45) Date of Patent: Jun. 21, 2011

(54) AUDIO SIGNAL PROCESSING METHOD AND APPARATUS

(75) Inventor: Shinji Kobayashi, Chiba (JP)

(73) Assignee: Sony Corporation (JP)

( * ) Notice: Subject to any disclaimer, the term of this patent is extended or adjusted under 35 U.S.C. 154(b) by 1222 days.

(21) Appl. No.: 11/302,013

(22) Filed: Dec. 13, 2005

(65) Prior Publication Data

US 2006/0159284 A1 Jul. 20, 2006

(30) Foreign Application Priority Data

Dec. 15, 2004 (JP) ..... P2004-363570

(51) Int. Cl.
*H03G 5/00* (2006.01)

(52) U.S. Cl. ..... 381/98

(58) Field of Classification Search ..... 381/98, 381/104, 107, 108, 300, 321, 1, 17, 18, 307, 381/120, 101, 102
See application file for complete search history.

(56) References Cited

U.S. PATENT DOCUMENTS

| | | | | |
|---|---|---|---|---|
| 4,815,354 | A * | 3/1989 | Kunimoto | 84/622 |
| 5,185,805 | A | 2/1993 | Chiang | |
| 5,481,617 | A | 1/1996 | Bjerre | |
| 5,506,910 | A * | 4/1996 | Miller et al. | 381/103 |
| 6,876,750 | B2 * | 4/2005 | Allred et al. | 381/314 |
| 6,954,538 | B2 * | 10/2005 | Shiraishi | 381/105 |
| 7,409,067 | B2 * | 8/2008 | Yoshino | 381/98 |

FOREIGN PATENT DOCUMENTS

| | | |
|---|---|---|
| EP | 0 404 117 A3 | 12/1990 |
| GB | 1114345 | 5/1968 |
| JP | 61-107298 | 5/1986 |
| JP | 63-266910 | 11/1988 |
| JP | 3074914 | 3/1991 |
| JP | 10-084595 | 3/1998 |
| JP | 2001/057697 | 2/2001 |
| JP | 2002-171589 A | 6/2002 |
| WO | WO-02/21687 | 3/2002 |
| WO | WO-02/41618 | 5/2002 |

OTHER PUBLICATIONS

Japanese Office Action issued on Apr. 1, 2008 in corresponding Japanese Application No. JP 2004-349053 (2 pages).
Japanese Office Action issued on Apr. 1, 2008 in connection with corresponding Japanese Application No. JP 2004-363570 (2 pages).

* cited by examiner

*Primary Examiner* — Vivian Chin
*Assistant Examiner* — Lun-See Lao
(74) *Attorney, Agent, or Firm* — Lerner, David, Littenberg, Krumholz & Mentlik, LLP

(57) ABSTRACT

In case of carrying out a correction process with respect to a signal of a specific frequency band in an inputted audio signal, an output level is raised approximately uniformly with respect to a signal component equal to a predetermined level or less in the signal of the specific frequency band and the output level is not changed with respect to signals other than the signal of the specific frequency band. In this manner, correction of a specific frequency band of an audio signal is carried out favorably.

7 Claims, 5 Drawing Sheets

AUDIO SIGNAL PROCESSING METHOD AND APPARATUS

CROSS-REFERENCE TO RELATED APPLICATIONS

The present application claims priority from Japanese Patent Application No. JP 2004-363570 filed on Dec. 15, 2004, the disclosure of which is hereby incorporated by reference herein.

BACKGROUND OF THE INVENTION

The present invention relates to an audio signal processing method and apparatus which carries out characteristic correction in case of reproducing an audio signal and more particularly relates to a technology preferably to be applied in case of using a speaker device for HIFI reproduction by which reproduction of a high-quality sound is possible.

In the past, various kinds of constitutions were in practical use as a speaker device for HIFI reproduction by which reproduction of a high-quality sound is possible. For example, there is known a speaker device having a three-way constitution in which reproduction bands of the audio signal are divided into three bands of a low band, a middle band and a high band and individual speaker units are provided for respective bands thereof. Reproduction faithful to an input audio signal from a low band to a high band becomes possible in the speaker device having a three-way constitution by using units as speaker units for respective bands in which reproduction characteristics thereof are favorable in respective bands and generally, the reproduction characteristic thereof becomes favorable as compared with a so-called full-range type speaker unit which outputs audio of all bands by a single speaker unit.

Also, other than the constitution in which the reproduced sound of the speaker device is made to be a high-quality sound by adopting such a three-way constitution or a two-way constitution, there has been adopted a constitution in which the characteristic of the audio signal itself supplied to the speaker device is corrected on the side of an amplifier device which is an audio signal processing apparatus such that the audio characteristic outputted from the speaker device is improved accordingly. For example, there is a case in which a correction referred to as a loudness control is carried out by an audio amplifier device which performs a processing of amplification of an audio signal driving the speaker device or the like. This loudness control is a control for carrying out a correction process which strengthens a bass portion and a treble portion in the output level thereof as compared with a midrange portion such that a phenomenon that the bass and treble portions sound insufficiently mainly on an occasion of a small volume is to be corrected.

In Japanese laid-open publication 2002-171589, there is a description with respect to one example of a reproducing constitution in case of carrying out a loudness correction. However, the loudness controlled reproduced sound simply strengthens a signal in a specific frequency band approximately uniformly regardless of its level, so that it cannot be said in the strict sense that a faithful reproduction with respect to the input audio signal is achieved and a development of a speaker device capable of achieving a more faithful reproduction with respect to the input audio signal has been desired. More specifically, since the reproduced sound which was loudness-controlled according to a conventional way strengthens a sound which cannot be caught easily on an occasion of a small volume to be reproduced, the bass portion and the treble portion become audible easily as compared with a reproduced sound which is not loudness-controlled and there is an effect of improving the sound quality to a certain degree, but the signal in a specific frequency band is to be strengthened uniformly regardless of a small level of a large level, so that it might happen that it may strengthen also with respect to a signal component which is unnecessary to be strengthened and as a result there is a case in which an unnatural reproduced sound is obtained.

Here, it will be explained with respect to a problem of the reproduced sound in a speaker device of related art, wherein there is a problem of a signal having a small amplitude as an example in a case when the reproduced sound does not reproduce the input audio signal faithfully. More specifically, for example, as shown in FIG. 1A, a case is assumed in which an input audio signal S1 of a continuous waveform having a waveform of a relatively large amplitude and a waveform of a relatively small amplitude. At that time, as a waveform of an audio signal S2 outputted from the speaker, it becomes approximately comparable with the input signal S1 with respect to a waveform of a relatively large amplitude and with respect to a waveform of a relatively small amplitude, there is a trend such that the amplitude thereof becomes smaller than that of the input signal S1. This is because the reproducing characteristic of a signal having small amplitude of a small volume is bad in a speaker unit having a shape provided with a general diaphragm capable of outputting in a relatively large sound and linearity of the input-output characteristic of a small volume signal cannot be assured.

Similarly as shown, for example, in FIG. 1B, when an input audio signal S3 having a waveform of a relatively large amplitude and an input audio signal S4 having a waveform of a relatively small amplitude overlap in time, an audio signal S5 composed by both the signals S3 and S4 is expected to be outputted primarily, but it becomes a state in which an output audio signal S6 having a waveform which is lowered in level as compared with the waveform of that composed signal S5 is to be outputted from the speaker. In a case, for example, when sounds of various musical instruments are to be reproduced concurrently such as a symphony as an audio to be reproduced from the speaker, such an output state may happen.

Further, as shown, for example, in FIG. 1C, in a case when there is an impulse signal as an input audio signal S7 in which a signal amplitude of a specific single frequency lowers gradually, it is true with respect to the waveform of an output audio signal S8 from the speaker that a following characteristic becomes deteriorated more as the level thereof becomes lower.

In any one of the examples of FIGS. 1A to 1*c*, the output level the signal having amplitude of a small volume becomes smaller than the input signal level with respect to the output from the speaker and it becomes a state in which linearity of a small signal cannot be maintained. When frequency-analyzing the state shown in FIGS. 1A to 1*c*, it becomes a state shown, for example in FIG. 2. The example of FIG. 2 is an example in which sensitivity is analyzed with respect to a fundamental wave f1 and its harmonics f 2 and f 3 which are higher harmonic waves of the fundamental wave. With respect to the fundamental wave f1 having a high level, it is outputted by a level as it was, but with respect to the harmonics f 2 and f 3 having smaller levels than the fundamental wave, the output sensitivities thereof become as shown by solid lines which are lowered than the primarily expected levels shown by dotted lines.

FIGS. 3A and 3B are drawings showing output characteristics from a low band to a high band in signal levels of a plurality of steps, wherein FIG. 3A shows an ideal characteristic and FIG. 3B is a drawing showing an output characteristic of an actual speaker. As shown in FIG. 3A, it is assumed in an ideal state such that four levels L1, L2, L3 and L4 were spaced approximately equally and it was a flat characteristic from a low band to a high band. At that time, with respect to the levels L1, L2 and L3 having high output levels for the output characteristic of an actual speaker shown in FIG. 3B, output characteristics approximately comparable with the ideal characteristic can be assured, but with respect to the characteristic of the lowest level L4, the levels are to be lowered from the primarily necessary levels by sensitivity $\alpha$ in any frequency bands.

The input-output characteristic diagram of FIG. 4 is a drawing when such sensitivity lowering is seen as a specific frequency characteristic. As shown in FIG. 4, while it is necessary primarily that the output level increased linearly with respect to the increase of the input signal level to the speaker so as to obtain a characteristic x of a dotted line, actually, the level changes approximately linearly in a level of a certain degree or more, but motion of the diaphragm with respect to the input is bad in a specific level or less such that a curved characteristic y is obtained in which the output sensitivity with respect to the input is very bad.

Specifically, in case of, for example, assuming that the maximum level for listening by a general speaker is to be 70 to 100 dBspl (sound pressure level), it can be said that a signal which is lowered from the maximum level by −30 dB to −60 dB does not output a sound volume which is correctly lowered by −30 dB to −60 dB with respect to the maximum level (is not proportional). Tentatively, when assuming a reproduction by a sound volume in which the output of the amplifier device is lowered from 100 dBspl by an amount of 50 dBspl, a sound volume before and after 50 dBspl should be obtained under an ordinary circumstance, but it happens actually, for example, that only an output of 40 dBspl which is lower than that by 10 dB can be obtained. In other words, it was recognized by an analysis of the present inventor that linearity cannot be fulfilled precisely and it becomes one of big causes for a phenomenon that a satisfied sound quality cannot be obtained.

There is a process as one of processes which are known in the past for correcting poorness in such a reproduction characteristic in which, for example, the loudness control mentioned above is carried out so as to strengthen the output level of a bass portion and a treble portion as compared with a midrange portion. Also, there is also a case as another process in which, for example, an apparatus referred to as a graphic equalizer is used and level strengthening or attenuating is carried out at respective frequency bands divided into plurality so as to adjust to become a reproduced sound quality preferable for a listener.

FIG. 5 is a drawing showing an example of compensation characteristic in case of using a conventional graphic equalizer. In a case when an audio signal gain is adjusted by a graphic equalizer, a person to adjust selects a band in which the gain is adjusted and the level to be strengthened or attenuated is set by an operation of an operation knob for gain setting for operating the band. More specifically, as shown in FIG. 5, when a band BW in which the gain is adjusted is selected, all signal components within that band are to be risen or lowered by the same amount in level by the operation of the operation knob for the gain setting with respect to that band. Consequently, in a case, for example, when the small signal in the band BW seems to be insufficient, an operation for rising the gain is carried out and as understood from FIG. 5, the gain rises by the same amount also with respect to a large signal within the same band and accordingly, there was a problem such that the audio signal within the band BW becomes very conspicuous as compared with other bands and it becomes an ill-balanced reproduced sound quality.

SUMMARY OF THE INVENTION

The present invention was invented in view of above aspects and is directed to making it possible to carry out correction of a specific frequency band of an audio signal favorably.

According to the present invention, an audio signal processing method carries out a correction process with respect to a signal of a specific frequency band in an inputted audio signal. The method includes raising an output level substantially uniformly for a signal component equal to a predetermined level or less in the signal of the specific frequency band; and not changing the output level for signals of other than the signal of the specific frequency band.

By doing this, only the signal level having a small amplitude equal to a predetermined level or less in a frequency band in which the signal is desired to be emphasized is raised by outputting a correction-processed audio signal, and with respect to signals having a relatively large amplitude equal to the predetermined level or more, the output level hardly changes, so that reproduction sensitivity of a low level signal in a desired frequency band can be improved without changing the overall signal level.

According to the present invention, only the signal level having a small amplitude equal to a predetermined level or less in a frequency band in which the signal is desired to be emphasized is raised by outputting a correction-processed audio signal, and with respect to signals having a relatively large amplitude equal to the predetermined level or more, the level thereof hardly changes regardless of the bands, so that reproduction sensitivity of a low level signal in a desired frequency band can be improved without changing the overall signal level and a favorable audio reproduction becomes possible.

In this case, the predetermined level is made, for the input-output characteristic of the speaker device outputting a corrected audio signal, to be a specific level in a case when it is a characteristic in which linearity of the output level with respect to the input signal is substantially assured in a specific level or more and the output level with respect to the input signal lowers in a specific level or less, so that a favorable signal correction in conformity with the characteristic of the speaker device can be carried out.

Also, the specific frequency band may be set variably according to an operation input, so that it becomes possible to carry out a signal correction in an arbitrary frequency band favorably.

DETAILED DESCRIPTION

Figure 6:
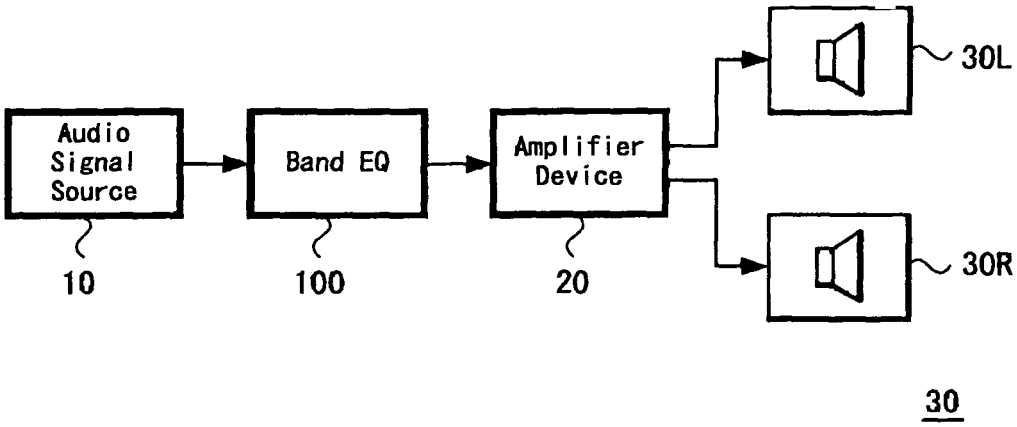
FIG. 6 is a block diagram showing a system constitutional example according to one exemplified embodiment of the present invention.

Hereinafter, a one exemplified embodiment of the present invention will be explained with reference to FIGS. 6 to 9. FIG. 6 a drawing showing a system constitutional example according to this exemplified embodiment. In this example, there is shown a speaker device connected to an audio reproduction system and FIG. 6 is a drawing showing the whole system constitutional example. In this example, an audio signal source 10 is connected to an amplifier device 20 through a graphic equalizer 100, an audio signal recorded (stored) in a medium of a CD (disc), memory or the like is reproduced by the audio signal source 10, the reproduced and outputted audio signal is supplied to the amplifier device 20 after being processed in the graphic equalizer 100 and a process is carried out in the amplifier device 20 for making an audio signal which drives the speaker device.

In case of this example, the audio signal audio outputted from the signal source 10 is a signal of two channels consisting of an audio signal for the left channel and an audio signal for the right channel. The audio signal for the left channel outputted from the amplifier device 20 is supplied to a speaker device 30L for the left channel to be outputted and the audio signal for the right channel there-from is supplied to a speaker device 30R for the left channel to be outputted.

The speaker device 30L for the left channel and the speaker device 30R for the right channel are to be formed to have the same constitution fundamentally (however, there is also a case with respect to contour shapes in which they are slightly different such as in case of bilaterally-symmetric shapes). It should be noted according to the explanation below when it is to be explained with respect to the speaker devices 30L and 30R for the right and left channels without distinguishing the channel thereof that there is also a case in which it is described by the speaker device 30 but with a reference numeral excluding L or R.

Figure 1A:
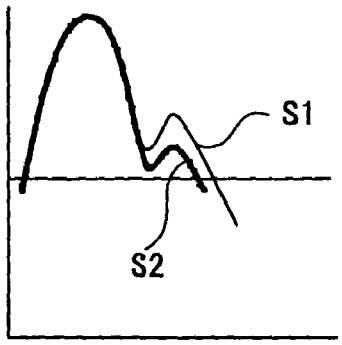
FIG. 1A (RELATED ART)
FIGS. 1A to 1C are explanatory diagrams showing an example of output waveforms of a speaker of related art.
Figure 1B:
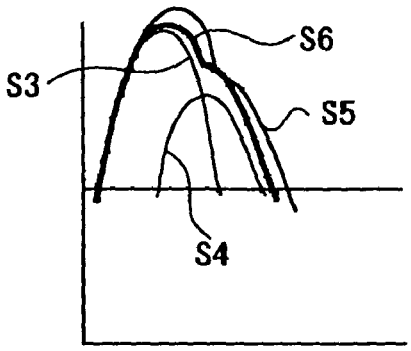
FIG. 1B (RELATED ART)
Figure 1C:
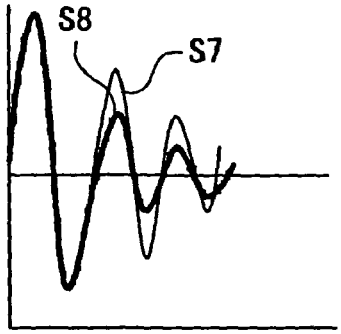
FIG. 1C (RELATED ART)
Figure 2:
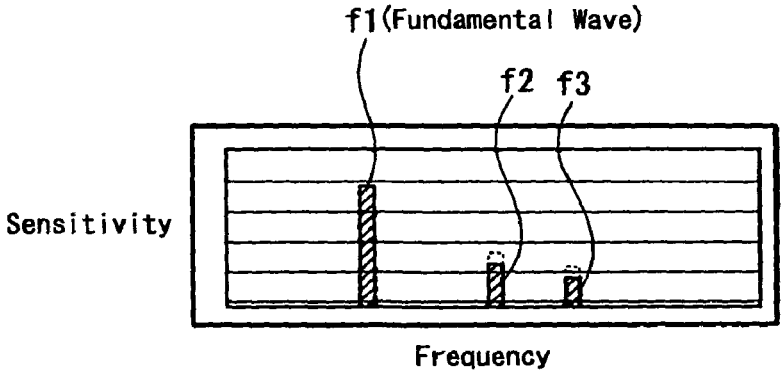
FIG. 2 (RELATED ART)
FIG. 2 is an explanatory diagram showing an example of signal level of a speaker of related art.
Figure 3A:
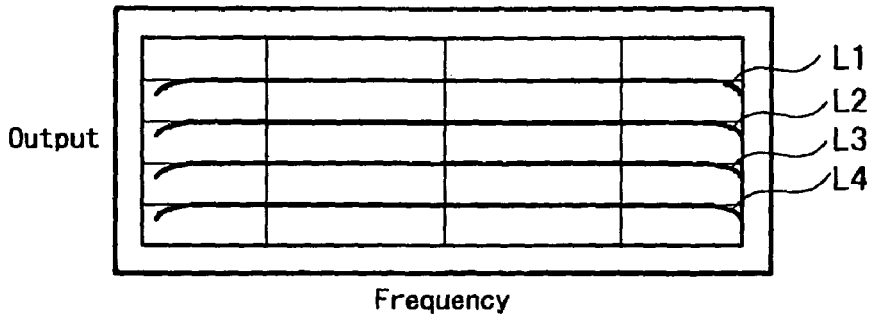
FIG. 3A (RELATED ART)
FIG. 3A is an explanatory diagram showing an example of output characteristic of an ideal speaker.
Figure 3B:
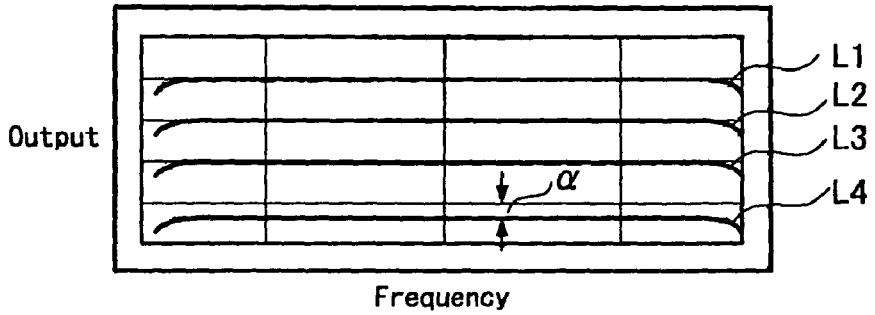
FIG. 3B (RELATED ART)
FIG. 3B is an explanatory diagram showing an example of output characteristic of a speaker of related art.
Figure 4:
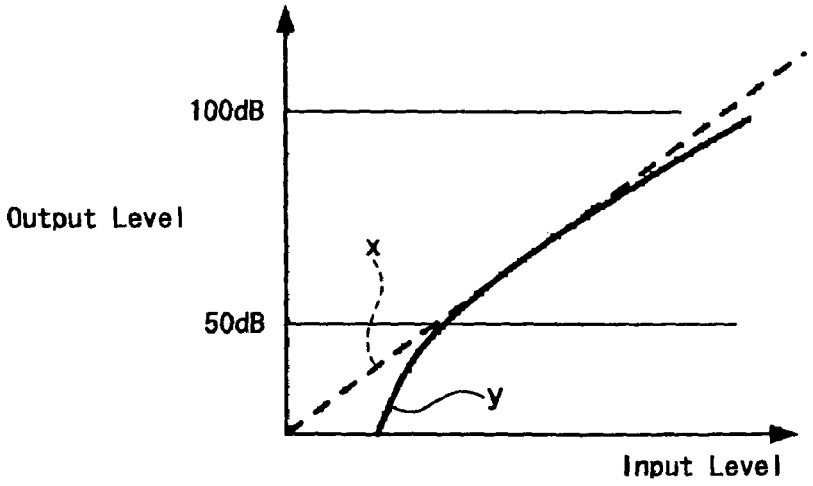
FIG. 4 (RELATED ART)
FIG. 4 is an explanatory diagram showing an example of input-output characteristic of a speaker of related art.
Figure 5:
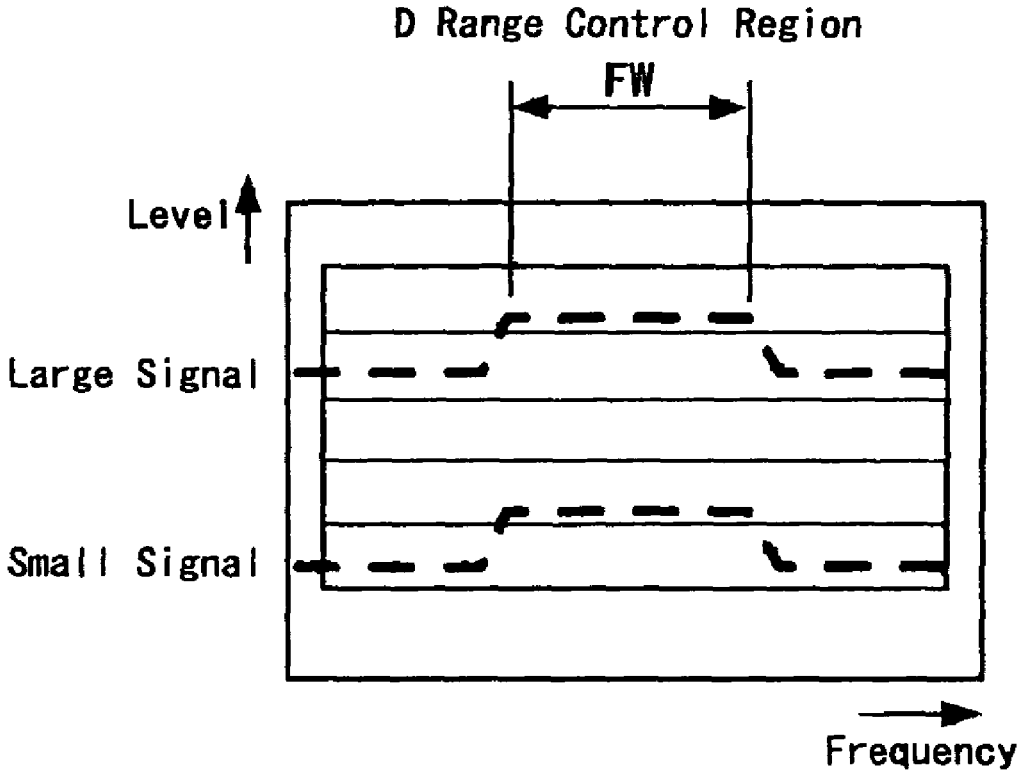
FIG. 5 (RELATED ART)
FIG. 5 is an explanatory diagram showing a characteristic example of a conventional band EQ.

It will be explained with respect to the constitution of each of the speaker devices 30L and 30R, wherein each of the respective speaker devices 30L and 30R is provided with one speaker unit 31 (FIG. 7) for a speaker unit as acoustic output means each for outputting audio. The each speaker unit 31 is a so-called full-range type speaker unit having approximately flat frequency characteristic in audible bands as characteristic seen from the outputted frequency bands and having characteristic in which it is outputted from a low band to a high band and it is constituted such that it is provided with a relatively large sized diaphragm and is a relatively large sized speaker unit capable of outputting a signal of a large sound volume. With respect to the speaker unit 31, the diaphragm is a relatively large, so that there is used such a unit in which linearity of input-output characteristic for a large signal equal to a predetermined level or more is approximately maintained, linearity of the input-output characteristic is not assured for the level equal to the predetermined level or less and the output signal level is inferior with respect to the input signal level. More specifically, a speaker unit having the characteristic y which is explained in the "Background of the Invention" with reference to FIG. 4 is to be used. A speaker unit possessing such a characteristic is a general unit as a speaker.

According to this example, it is constituted in an audio reproduction system in which the speaker device 30 using the speaker unit 31 possessing such a characteristic is connected such that a signal characteristic correction is carried out in the graphic equalizer 100 connected in a preceding stage of the amplifier device 20 which processes an audio signal to be supplied to the speaker device 30.

Figure 7:
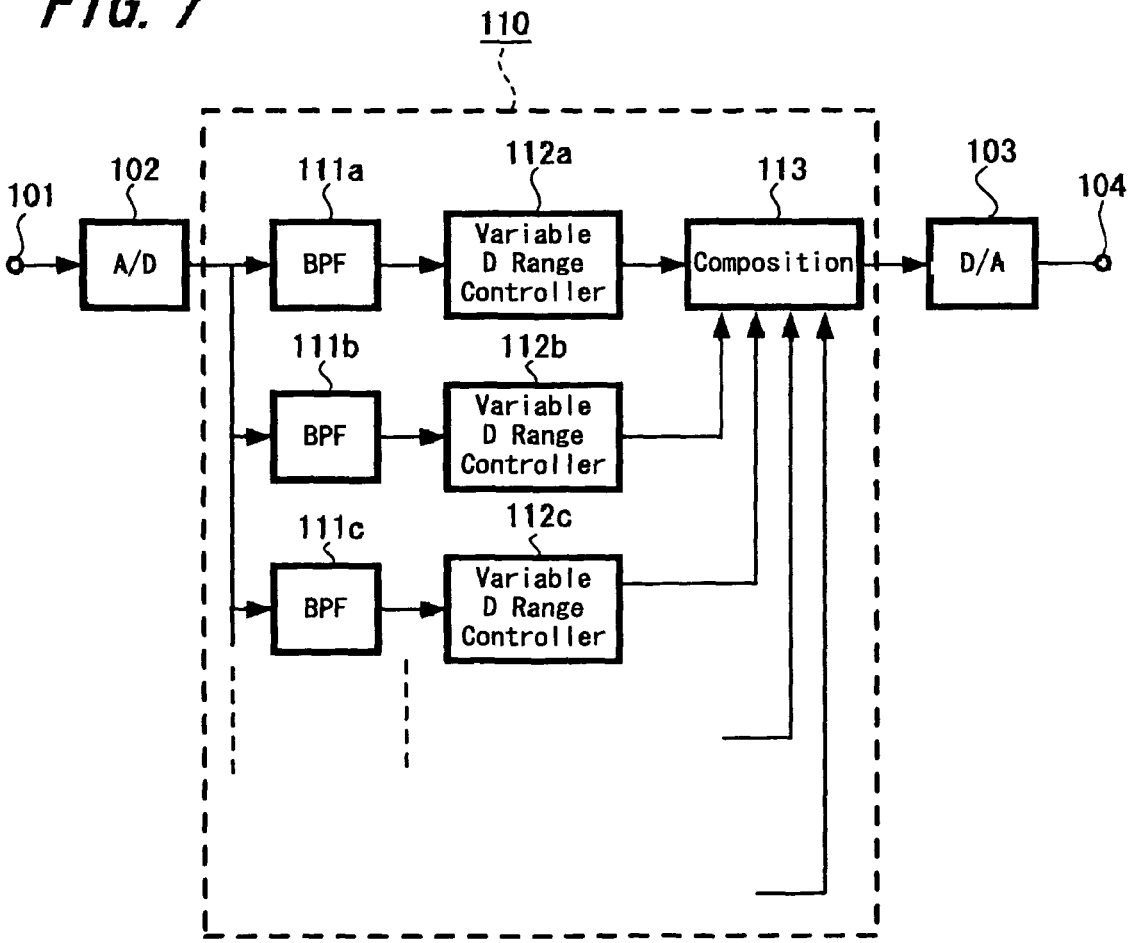
FIG. 7 is a constitutional diagram showing a constitutional example according to one exemplified embodiment of the present invention.

FIG. 7 is a drawing showing a constitutional example of the graphic equalizer 100 according to this example. An audio signal obtained at an audio signal input terminal 101 of the graphic equalizer 100 is supplied to an analog/digital converter 102 so as to be converted to a digital audio signal and the converted digital audio signal is supplied to a DSP (digital-signal-processor) 110.

As the processing constitution within the DSP 110, the audio signal is divided into signal components of respective frequency bands for processing by using a plurality of band-pass filters 111*a* to 111*n* (n is arbitrary integer of two or more), the divided respective signal components are supplied to variable dynamic range controllers 112*a* to 112*n* and variable dynamic range controlling processes are carried out for the respective bands by digital operation processes. With respect to the amount of adjustment which carries out the dynamic range controlling process in each band is set by an operation situation of an operation unit which is not shown. This variable dynamic range controlling process is a signal process which becomes characteristic in this exemplified embodiment and the details thereof will be described later.

Then, the signal components processed in the variable dynamic range controllers 112*a* to 112*n* are supplied to a composition unit 113 so as to be composed to audio data in one system, the composed audio data are supplied to a digital/analog converter 103 so as to be converted to an analog audio signal and the converted audio signal is supplied to an apparatus of a succeeding stage (amplifier device 20 in case of the constitution of FIG. 6) from an audio signal output terminal 104. It should be noted in the constitution of FIG. 7 that there is shown only a constitution for processing an audio signal of one channel, but in a case, for example, when an audio signal of two channels such as shown in FIG. 6 is processed, the circuit configuration shown in FIG. 7 will be provided for two systems. Also, the constitution shown in FIG. 7 is a constitution seen from a data processing function the filter 111*a* to 111*n* or the controller 112*a* to 112*n* are not always provided with a number n of processing units within the DSP.

Figure 8:
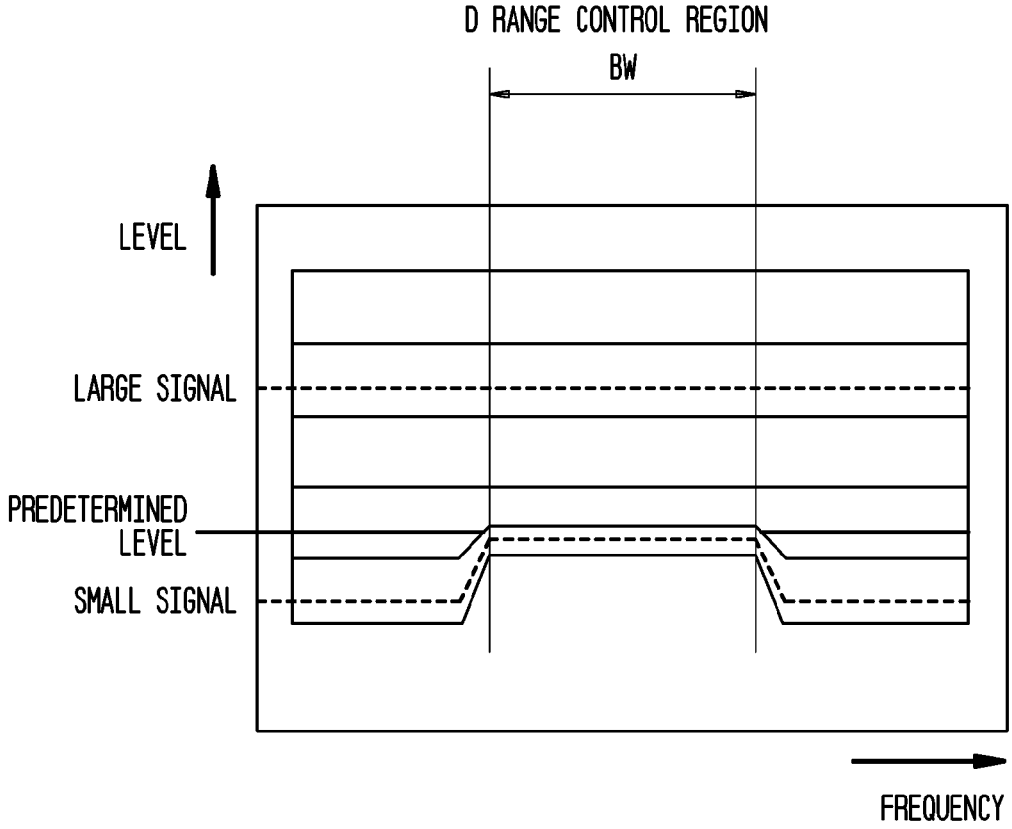
FIG. 8 is a characteristic diagram showing an example of compensation characteristic according to one exemplified embodiment of the present invention.

Next, it will be explained with respect to a processing example in the graphic equalizer 100 according to this example, wherein as shown, for example, in FIG. 8, it is assumed with respect to the frequency band BW of the inputted audio signal such that it is to be set so as to carry out a dynamic-range control by the operation of the operation unit. At that time, the dynamic range is changed by a variable dynamic range controller 112*x* (controller 112*x* is any one of controllers in the controllers 112*a* to 112*n*) which processes an output of a band-pass filter 111*x* (filter 111*x* is any one of filters in the filters 111*a* to 111*n*) taking out the signal component of the band BW. FIG. 8 shows an example in which only one band BW is corrected, but it is also possible to carry out correction processes concurrently in a plurality of frequency bands in the bands which were dividing-set by the filters 111*a* to 111*n*.

For a changing process of the dynamic range here, as shown in FIG. 8, it is constituted with respect to the audio signal in the frequency band BW such that the level is not made to change with respect to a large signal having a level equal to a predetermined level or more and the level is made to raise with respect to a small signal having the level equal to the predetermined level or less. The predetermined level is determined, for example, according to the input-output characteristic possessed by the speaker units which the connected speaker device 30L and 30R are provided with. Specifically, the level of the boundary between the region in which linearity of the input-output characteristic of the speaker unit is approximately maintained and the region in which linearity of the input-output characteristic is not assured is made to be approximately in coincide with the predetermined level. Also, it is constituted with respect to the characteristic which raises the level of a small signal equal to the predetermined level or less such that it becomes a characteristic shown by a curve in which the lower the level is the higher the increasing rate becomes as compared with the characteristic in which the input and the output become equal to each other and it is to be operated so as to correct poorness of the input-output characteristic which the speaker unit possesses.

Figure 9:
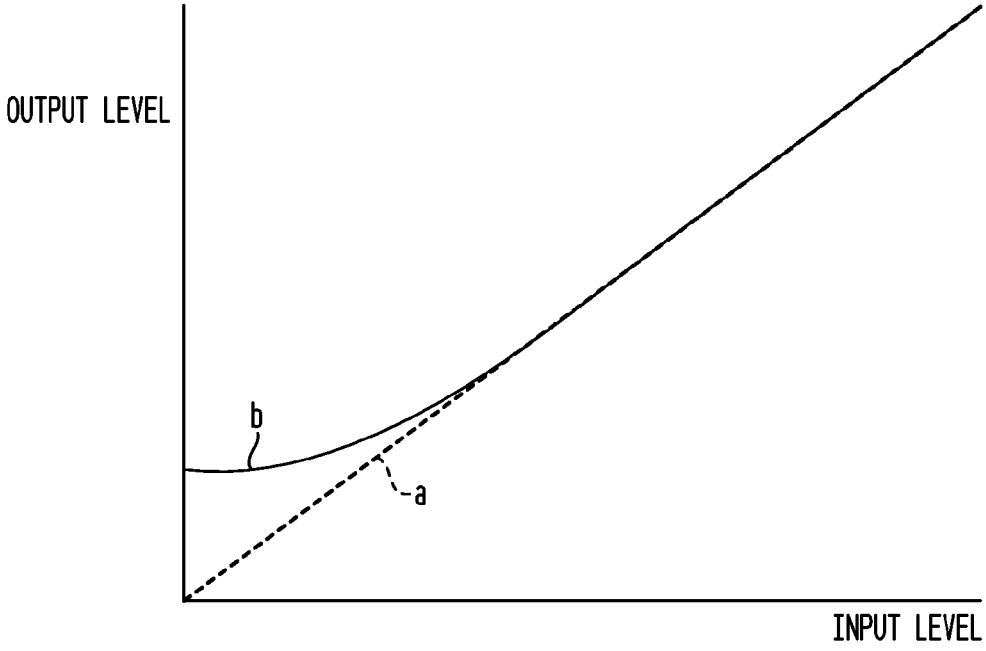
FIG. 9 is a characteristic diagram showing an example of a correction state according to one exemplified embodiment of the present invention in which output sensitivity at every frequency is shown.

Specifically, as shown in FIG. 4 which was explained in the "Background of the Invention", when it is assumed for the input-output characteristic of the speaker unit that a characteristic y shown by a curve is true at a level equal to a predetermined level or less in which linearity of the input-output characteristic is not assured, it is constituted with respect to the audio signal equal to the predetermined level or less such that, for example, as shown in FIG. 9, a characteristic b in which the input and the output of the characteristic y is approximately reversed is to be obtained within the frequency band BW. It should be noted that the characteristic a shown in FIG. 9 is shown just for reference for showing an ideal characteristic in which the linearity of input-output is assured.

However, it may be constituted by making the amount of adjustment which becomes the characteristic b shown in FIG. 9 as a reference amount of adjustment such that it makes it possible to adjust increasing rate or the like of a small signal from the reference amount of adjustment so as to increase and decrease it by a user operation or the like. Also, it may be constituted such that it makes it possible to variably set the level value itself at the boundary point for which the level of a small signal is to be raised (above-mentioned predetermined level).

A dynamic range correction process is carried out by such a correction, so that poorness of the input-output linearity is to be corrected in a frequency band for which the correction is carried out and it becomes a characteristic close to the ideal characteristic a. For example, by carrying out a dynamic range correction process such as shown in FIG. 8 with respect to a frequency band of a high band or a middle band in which a signal of a relatively small level can be caught easily, the output characteristic from the connected speaker device 30 becomes favorable. In a case when, it is not corrected (strengthened) in any frequency band at all with respect to the signal reproduction level of a large level, so that the dynamic range correction can be carried out only with respect to a desired frequency band without upsetting the overall reproduction balance and a favorable reproduced sound can be obtained.

Furthermore, in case of the present invention, the dynamic range correction process can be carried out for every frequency band dividing-set by the graphic equalizer 100, so that a user can carry out an adjustment while actually listening to the audio outputted from the speaker device and it becomes possible to carry out a favorable adjustment of how to obtain a favorable reproduced output with respect to what band the correction process should be applied while actually listening to the reproduced music or the like. For example, in case of raising the level of a small signal with respect to a certain frequency band and in a case when a noise of a reproduced sound becomes conspicuous, the level of a small signal with respect to another frequency band avoiding that band may be raised.

Also, for example, by applying an audio reproduction system of the present invention to a reproduction system for a so-called car stereo which is installed in a vehicle such as a car or the like, a sound of small level which may vanish into the noise generally will be caught easily in a reproduction environment in which the influence of noises outside the vehicle is large and particularly, by applying the process with respect to a frequency band in which the influence of noises outside the vehicle is large, the reproduced sound quality is improved.

It should be noted in the above-mentioned exemplified embodiment that a concrete example was not particularly shown with respect to a division example of the frequency bands carrying out the correction process, but well-known various kinds of division examples are applicable as the graphic equalizer. For example, it can be chosen from one of a case in which the audible band is divided by a relatively few number of divisions of around four bands and a case in which it is divided minutely by ten bands or more.

Also, a constitution in which a frequency position or a frequency band width of each band can be set variably may be employed instead of determining division bands fixedly by the provided filter and it may be constituted such that an arbitrary frequency band carrying out the correction process or the like can be set.

Also, it was constituted in the exemplified embodiments mentioned above such that a graphic equalizer is provided as a dedicated audio signal processing means (correction means) for carrying out a correction process so as to be connected between the audio signal source and the amplifier device, but it may be constituted such that correction means for carrying out a similar correction process is to be built-in in one of various kinds of audio equipment such as audio signal source, amplifier device, speaker device or the like so as to carry out the process.

Alternatively, it may be constituted such that a port capable of inputting and outputting an audio signal is provided in an arithmetic processing apparatus such as a personal computer apparatus, a program for carrying out a similar audio signal correction is mounted on the arithmetic processing apparatus and an apparatus for carrying out a correction process of a similar audio signal is to be realized by the arithmetic process.

Also, in the exemplified embodiments mentioned above, application to a system for two channels audio reproduction shown in FIG. 6 was assumed, but it may be constituted as a system for multi channel audio reproduction such as for the 5.1 channel.

It should be understood by those skilled in the art that various modifications, combinations, sub-combinations and alterations may occur depending on design requirements and other factors insofar as they are within the scope of the appended claims or the equivalents thereof.

The invention claimed is:

1. An audio signal processing method, comprising:

filtering an inputted audio signal into a plurality of signal components corresponding to a plurality of frequency bands using a corresponding plurality of band-pass filters whereby a given one of the plurality of band-pass filter corresponds to a respective one of the plurality of frequency bands;

concurrently raising, using correction circuitry, output levels substantially uniformly only for specific ones of the plurality of signal components having output levels that are equal to or less than a predetermined level, the specific ones of the plurality of signal components corresponding to specific ones of the plurality of frequency bands; and not changing the output levels for signal components other than those corresponding to the specific ones of the plurality of frequency bands.

2. An audio signal processing method according to claim 1, wherein the predetermined level is a specific level in case of characteristic as input-output characteristic of a speaker device from which corrected audio signal is to be outputted in which linearity of an output level with respect to an input signal is substantially assured in a specific level or more and an output level with respect to an input signal lowers in the specific level or less.

3. An audio signal processing method according to claim 1, wherein the specific frequency bands are set variably according to an operation input.

4. An audio signal processing apparatus, comprising:

a plurality of band-pass filters operable to filter an inputted audio signal into a plurality of signal components corresponding to a plurality of frequency bands associated with respective ones of the plurality of band-pass filters; and correction circuitry coupled to each one of the plurality of band-pass filters and operable to concurrently raise output level substantially uniformly only for specific ones of the plurality of signal components having output levels that are equal to a predetermined level or less the specific ones of the plurality of signal components corresponding to specific ones of the plurality of frequency bands and without changing the output levels of signals other than those corresponding to the specific ones of the plurality of frequency bands.

5. An audio signal processing apparatus according to claim 4, wherein the predetermined level is a specific level in case of characteristic as input-output characteristic of a speaker device from which corrected audio signal is to be outputted in which linearity of an output level with respect to an input signal is substantially assured in a specific level or more and an output level with respect to an input signal lowers in the specific level or less.

6. An audio signal processing apparatus according to claim 4, further comprising operation means for setting the specific frequency bands in the correction means.

7. An apparatus for processing an audio signal, the apparatus comprising:

a digital signal processor for concurrently raising output levels of only specific signal components having output levels that are less than or equal to a predetermined signal level without changing output levels for other signal components having output levels that are greater than the predetermined level, wherein the digital signal processor comprises one or more band pass filters each coupled to a respective one of one or more variable range controllers for raising the levels of the specific signal components.

* * * * *